US010190829B2

(12) United States Patent
Birk

(10) Patent No.: US 10,190,829 B2
(45) Date of Patent: Jan. 29, 2019

(54) QUENCH-COOLING SYSTEM

(71) Applicant: BORSIG GMBH, Berlin (DE)

(72) Inventor: Carsten Birk, Glienicke (DE)

(73) Assignee: BORSIG GMBH, Berlin (DE)

( * ) Notice: Subject to any disclaimer, the term of this patent is extended or adjusted under 35 U.S.C. 154(b) by 282 days.

(21) Appl. No.: 14/963,605

(22) Filed: Dec. 9, 2015

(65) Prior Publication Data

US 2016/0169589 A1 Jun. 16, 2016

(30) Foreign Application Priority Data

Dec. 11, 2014 (DE) ..... 10 2014 018 261

(51) Int. Cl.
*F28G 1/12* (2006.01)
*F28F 9/02* (2006.01)
(Continued)

(52) U.S. Cl.
CPC ..... *F28D 7/163* (2013.01); *F28D 7/0075* (2013.01); *F28D 7/106* (2013.01); *F28D 7/16* (2013.01); *F28D 7/1653* (2013.01); *F28F 9/0226* (2013.01); *F28F 9/0229* (2013.01); *F28F 13/08* (2013.01); *F28D 2021/0022* (2013.01); *F28D 2021/0056* (2013.01); *F28D 2021/0059* (2013.01); *F28D 2021/0075* (2013.01)

(58) Field of Classification Search
CPC ..... C10B 43/00; F28F 1/006; F28F 1/025; F28G 1/166; F22B 37/48; F28D 7/163; F28D 7/0075; F28D 7/106; F28D 7/16
USPC ..... 165/95, 134.1, 146; 122/382, 390
See application file for complete search history.

(56) References Cited

U.S. PATENT DOCUMENTS 3,593,779 A * 7/1971 Tokumitsu ..... B01D 51/10 165/95
3,833,058 A 9/1974 Gulich
(Continued)

FOREIGN PATENT DOCUMENTS

AT 361 953 B 4/1981
DE 73 05 711 U 8/1973
(Continued)

OTHER PUBLICATIONS

Translation of European patent document EP 0034223 A1 entitled Translation—EP 0034223 A1.*

*Primary Examiner* — Len Tran
*Assistant Examiner* — Paul Alvare
(74) *Attorney, Agent, or Firm* — McGlew and Tuttle, P.C.

(57) ABSTRACT

A quench-cooling system has a primary quench cooler as a double-tube heat exchanger, a tube bundle heat exchanger as a secondary quench cooler. A tube bundle is enclosed by a casing, forming a casing room, which is formed between tube sheets arranged at spaced locations. Bundle tubes are held with the tube sheets. Parallel cooling channels, connected with one another, have a rectangular tunnel geometry formed (i) from the thin tube sheet, separating a gas side from a water/steam side and connected to a ring flange, which is connected to the casing of the enclosed tube bundle; (ii) from parallel webs, arranged on the tube sheet, separating individual water/steam flows from one another; and (iii) from a covering sheet, provided with openings for bundle tubes and defining the flow in the tunnel arrangement of the cooling channels.

10 Claims, 6 Drawing Sheets

(51) Int. Cl.

| | |
|---|---|
| ***F28F 13/00*** | (2006.01) |
| ***F28F 19/00*** | (2006.01) |
| ***F22B 37/54*** | (2006.01) |
| ***F28G 9/00*** | (2006.01) |
| ***F28G 15/00*** | (2006.01) |
| ***F22B 37/52*** | (2006.01) |
| ***F28D 7/16*** | (2006.01) |
| ***F28F 13/08*** | (2006.01) |
| ***F28D 7/00*** | (2006.01) |
| ***F28D 7/10*** | (2006.01) |
| *F28D 21/00* | (2006.01) |

(56) References Cited

U.S. PATENT DOCUMENTS

| | | | | | |
|---|---|---|---|---|---|
| 3,913,531 | A * | 10/1975 | von Hollen | ..... | F22B 1/025<br>122/32 |
| 4,700,773 | A * | 10/1987 | Kehrer | ..... | F22B 1/1884<br>165/134.1 |
| 5,035,283 | A * | 7/1991 | Brucher | ..... | F28D 7/16<br>165/134.1 |
| 5,579,831 | A | 12/1996 | Brücher | | |
| 6,334,483 | B1 | 1/2002 | Berglund et al. | | |

FOREIGN PATENT DOCUMENTS

| | | | | | |
|---|---|---|---|---|---|
| DE | 44 45 687 | A1 | 6/1996 | | |
| EP | 0034223 | A1 * | 8/1981 | ..... | H01L 23/467 |
| EP | 0 417 428 | B1 | 9/1993 | | |
| WO | 01/48 434 | A1 | 7/2001 | | |
| WO | WO 0148434 | A1 * | 7/2001 | ..... | F22B 37/483 |

* cited by examiner

QUENCH-COOLING SYSTEM

CROSS REFERENCE TO RELATED APPLICATIONS

This application claims the benefit of priority under 35 U.S.C. § 119 of German Patent Application 10 2014 018 261.4 filed Dec. 11, 2014, the entire contents of which are incorporated herein by reference.

FIELD OF THE INVENTION

The present invention pertains to a quench-cooling system with a primary quench cooler as a double-tube heat exchanger and with a tube bundle heat exchanger as a secondary quench cooler with at least one tube bundle, wherein the tube bundle is enclosed by a casing, forming a casing space, which is formed between two tube sheets arranged at spaced locations from one another, with bundle tubes of the tube bundle being held between the tube sheets in the tube sheets on both sides, and wherein the tube sheet is designed on the side of the gas inlet or gas outlet with the bundle tubes as a membrane sheet or thin tube sheet.

BACKGROUND OF THE INVENTION

Cracking furnaces are used in a two-stage cooling system in some plants for producing ethylene. A vertically arranged double-tube heat exchanger is usually provided in this case as a primary quench cooler and a conventional, vertically or horizontally arranged tube bundle heat exchanger as a secondary quench cooler.

Such a tube bundle heat exchanger is used as a process gas waste heat boiler for rapidly cooling reaction gases from cracking furnaces or chemical plant reactors while at the same time generating high-pressure steam as the cooling medium removing the generated heat.

A tube bundle heat exchanger is known from EP 0 417 428 B1, in which heat exchanger at least one tube bundle is enclosed by a casing, forming an interior space, which is formed between two tube sheets arranged at spaced locations from one another, wherein tubes of the tube bundles are held each on both sides in the tube sheets. The tube sheet is provided on the gas inlet side with open turn-outs concentrically enclosing the tubes and parallel cooling channels, which are in connection with one another and through which a cooling medium flows.

Further, a tube bundle heat exchanger is known from WO 01/48434 A1, which heat exchanger has a casing, which is under pressure, and a lower tube plate, which separates the interior space of the casing from an inlet distributor for the entry of the fluid to be cooled. The lower tube plate has passages for the fluid, and cleaning passages are arranged laterally close to the inner surface of the tube plate for connection to the outside of the casing, and said cleaning passages are intended for inserting a device through the casing in order to clean the tube plate at the foot of the tube bundle. Inspection passages may also be present close to the plate surface for a visual inspection of the zone to be cleaned.

High velocity of the flow of water over the tube sheet is very decisive in case of vertically arranged secondary quench coolers, in which the tube sheet at the gas inlet according or at the gas outlet represents the lowest point in the water system, in order to avoid harmful effects in respect to the tube sheet. Such effects arise, e.g., due to deposits as a consequence of corrosion and due to overheating as a consequence of the settling of solid particles on the tube sheet.

Small solid particles very frequently enter the water of the water flow arrangement of the quench cooler, especially during the start-up of such a plant, for example, for ethylene production. In addition, the water-side metal surfaces of the tube sheet, of the tubes and of the casing produce a layer of magnetite or $Fe_3O_4$. The magnetite layer protects the steel of the tube sheet and it always slowly regenerates itself from the metal surface at operating temperature, while a small quantity of particles consisting of magnetite is released into the water.

Besides the high velocity of the water flow, it is just as important to guide the water flow over the tube sheet away from sensitive areas of the tube sheet, e.g., the middle of the tube sheet with the highest heat flux, to areas in which effective blow-down can be employed.

The tube sheet of the secondary quench cooler is designed as a so-called membrane design and comprises a thin plate with a thickness of about 25 mm. The bundle tubes of the quench cooler are welded onto the thin plate.

No devices are provided on the plate for routing the water flow over the tube sheet of the gas inlet or of the gas outlet.

SUMMARY OF THE INVENTION

An object of the present invention is to provide a quench-cooling system with a medium flow arrangement, in which the flow of medium is routed over the tube sheet of the gas inlet side or the gas outlet side such that, depending on the connection of the secondary quench cooler, deposits are prevented from forming. Another object is to provide an access, through which the tube sheet can be inspected and, depending on the inspection, cleaned in a simple manner, to the medium flow arrangement on the tube sheet on the side of the gas inlet or of the gas outlet.

The stated object is accomplished by a quench-cooling system with a primary quench cooler as a double-tube heat exchanger and with a tube bundle heat exchanger as a secondary quench cooler with at least one tube bundle, wherein the tube bundle is enclosed by a casing, forming a casing room, which is formed between two tube sheets arranged at spaced locations from one another, between which tube sheets bundle tubes of the tube bundle are held in the tube sheets on both sides. The tube sheet on the side of the gas inlet or gas outlet is configured as a thin tube sheet of the membrane design with the bundle tubes. The thin tube sheet is provided with parallel cooling channels, which are in connection with one another and through which a cooling medium flows. The cooling channels are configured in a tunnel arrangement and arranged on a tube plate as a thin tube sheet. The cooling channels configured in the tunnel arrangement have a rectangular tunnel geometry. The cooling channels with the tunnel geometry are formed from the thin tube sheet, which separates a gas side from a water/steam side, and is connected to a ring flange, which is connected to the casing of the enclosed tube sheet; from parallel webs, which are arranged on the tube sheet, are connected to the tube sheet and separate individual water/steam flows from one another; and from a covering sheet, which is provided with openings (passages) for bundle tubes and which is connected to the webs and defines the flow in the tunnel arrangement of the cooling channels and prevents the flow from escaping into a casing room (or jacket space) enclosed by the casing of the enclosed tube bundle aside from a predetermined percentage. The cooling channels configured in the tunnel arrangement bring about an unambiguously directed flow from the inlet openings in the direction of the outlet openings of the cooling channels.

It proved to be particularly advantageous when at least two of the respective cooling channels in a tunnel arrangement show a change in the cross section of the cooling channels or of the tunnels due to a continuous reduction of the tunnel height from the inlet opening to the outlet opening by a predetermined angle $\alpha$, which is formed between the vertical line of the outlet opening and the covering sheet.

Furthermore, it proved to be advantageous when the predetermined angle $\alpha$ formed between the vertical line of the outlet opening of a cooling channel and the covering sheet is in the range of greater than/equal to 90° to 110°, because the angle depends on the predetermined increase in the necessary velocity of the flow over predetermined areas of the tube sheet to be cooled.

It must be considered another advantage in another design of the quench-cooling system according to the present invention that inspection or cleaning nozzles are arranged, opposite each other and flush, at the level of the cooling channels in a tunnel arrangement on the outer surface side of the ring flange connected to the casing and that the inspection or cleaning nozzles communicate with the cooling channels in a tunnel arrangement via openings in the ring flange.

Furthermore, it was found to be advantageous when the inspection or cleaning nozzles associated with the cooling channels and arranged opposite each other and flush on the ring flange are equipped with covers and when the covers or individual covers of the respective inspection or cleaning nozzles located opposite each other are arranged removably as a opening for the water-side maintenance or inspection of the bundle tubes in the area of the cooling channels in a tunnel arrangement.

Furthermore, it was found to be advantageous in the quench-cooling system according to the present invention that the covers or individual covers of the respective opposite inspection or cleaning nozzles are arranged removably as a opening for cleaning out existing deposits in the area of the cooling channels in a tunnel arrangement with a water jet.

It was found to be advantageous in another embodiment of the quench-cooling system according to the present invention that the inspection or cleaning nozzles associated with the cooling channels and arranged opposite each other and flush on the ring flange communicate with a boiler blow-down tank arranged on one side at the level of the cooling channels in a tunnel arrangement via the openings in the ring flange and via welded-on drain pipes as a continuation of the openings on the ring flange.

Furthermore, it is especially advantageous that the inspection or cleaning nozzles are arranged on the outer side of the boiler blow-down tank, which outer side is located opposite the drain pipes.

If the quench-cooling system is provided with the boiler blow-down tank, it is advantageous that the inspection or cleaning nozzles are arranged directly on the ring flange opposite the side on which the boiler blow-down tank is arranged.

The preferred tunnel flow design ensures high velocity of flow of the medium over the tube sheet on the gas inlet side or the gas outlet side. Because of the high velocity of flow of the medium, solid particles cannot, in principle, settle on the tube sheet. Since settling of solid particles on the tube sheet does not essentially occur, overheating of the tube sheet and hot water corrosion cannot develop.

The tunnel flow arrangement has two decisive features. First, solid particles do not essentially settle because of the generated high velocity of flow of the medium through the advantageous tunnel flow arrangement, and, second, overheating of the tube sheet and hence hot water corrosion do not develop due to the provision of a guided intense cooling. The tunnel flow arrangement ensures a continuous and uniform flow of water to and along the tube sheet of the gas inlet side or of the gas outlet side of a vertically arranged secondary quench cooler, and solid particles and sludge are essentially prevented from settling on the water side.

The service life and reliability of a quench-cooling system is considerably increased in such a way due to the embodiment of the advantageous tunnel flow arrangement on the respective tube sheet.

In another embodiment of the quench-cooling system according to the present invention, provisions are advantageously made for ensuring continuous access, via the inspection and cleaning nozzles, with the covers removed, to each cooling channel arranged on the tube sheet, so that said cooling channel can then be cleaned by introducing water as a preferred medium under high pressure either from both sides or from only one side. The blow-down water always leaves the cooling channel on the opposite side, preferably via drain pipes, into the boiler blow-down tank provided.

Further advantages of the present invention are shown in the drawings on the basis of exemplary embodiments and will be described in more detail below.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
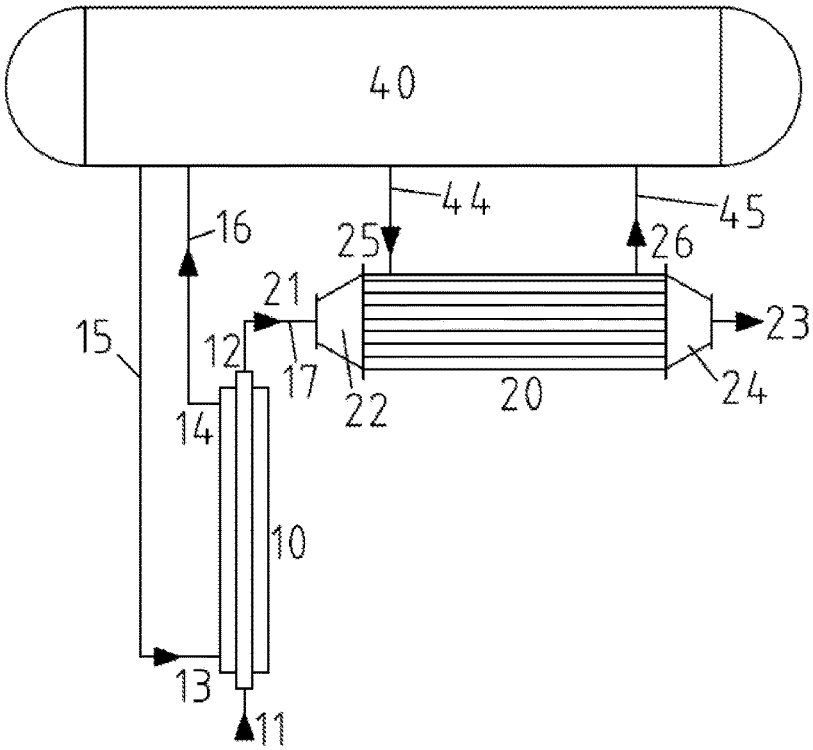
FIG. 1 is a schematic view showing a quench-cooling system according to the invention with a typical flow arrangement and with a primary quench cooler in a vertical arrangement and with a secondary quench cooler, according to the invention, in a horizontal arrangement.
Figure 2A:
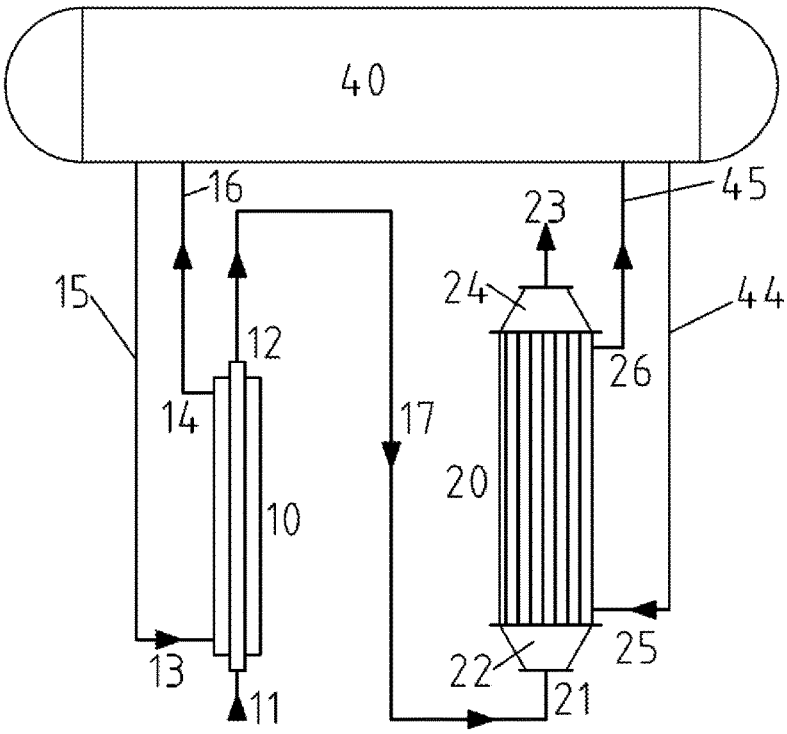
FIG. 2A is a schematic view showing a quench-cooling system according to the invention with a typical flow arrangement similar to that in FIG. 1 and with a primary quench cooler in vertical arrangement and with a secondary quench cooler, according to the invention, in a vertical arrangement with a gas inlet arranged at the lower end.
Figure 2B:
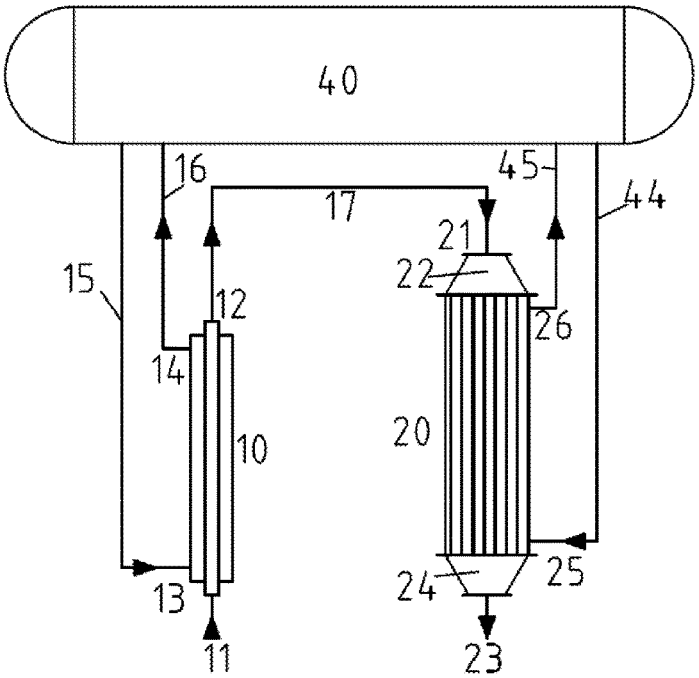
FIG. 2B is a schematic view showing a quench-cooling system according to the invention with a typical flow arrangement similar to that in FIG. 2A and with a gas inlet arranged at the upper end with a secondary quench cooler, according to the invention, in a vertical arrangement.

Referring to the drawings, quench-cooling systems, according to the invention, are schematically shown in FIGS. 1, 2*a* and 2 *b*, with a secondary quench cooler 20 of the quench-cooling system according to the invention. In the views being shown, the primary quench cooler 10 is always configured as a double-tube heat exchanger in the vertical position, while the tube bundle heat exchanger acting as a secondary quench cooler 20 is arranged in the horizontal position according to FIG. 1 and in the vertical position in two different arrangements for the gas inlet and gas outlet according to FIGS. 2A and 2B.

The flow arrangements of the two different primary and secondary quench coolers, which serve a common steam drum arranged in an elevated position, are the preferred embodiments in connection with the firebox of a cracking furnace. The quench coolers are arranged in most cases above the radiant section of the cracking furnace.

The quench-cooling system shown in FIG. 1 comprises, in general, a vertically arranged double-tube heat exchanger as a primary quench cooler 10 and a conventional, horizontally arranged tube bundle heat exchanger as a secondary quench cooler 20, with features according to the invention. The arrangement of the two different quench coolers, which serve a common steam drum 40 arranged in an elevated position, is one of the preferred arrangements in connection with a firebox, not shown, of a cracking furnace, likewise not shown.

A gas inlet opening 11 for a gas stream according to the direction of the arrow is arranged at the lower end of the vertically arranged primary quench cooler 10. The gas stream leaves the vertically arranged primary quench cooler 10 at the upper end at the gas outlet opening 12 in a predetermined, cooled state. The cooled gas stream is fed to the secondary quench cooler 20 on the side of the gas inlet via a pipeline 17 arranged between the gas outlet opening 12 of the primary quench cooler 10 and a gas inlet 21 of an inlet header 22 of the horizontally arranged secondary quench cooler 20 in order to be cooled further, and it leaves the secondary quench cooler 20 on the opposite side at the gas outlet 23 of an outlet header 24.

The cooling medium, especially water, is fed to the primary quench cooler 10 from the steam drum 40 according to the direction of the arrow via a feed pipeline 15 above the gas inlet opening 11 at the cooling water inlet opening 13 and leaves the quench cooler 10 as a water/steam mixture via an uptake tube 16 under the gas outlet opening 12 at the cooling water outlet opening 14 back into the steam drum 40. The cooling medium is fed to the horizontally arranged secondary quench cooler 20 according to the direction of the arrow via a secondary feed pipeline 44 behind the inlet header 22 at the cooling water inlet 25 from the steam drum 40 and leaves the quench cooler as a water/steam mixture in front of the outlet header 24 via a cooling water outlet 26 and a secondary uptake tube 45 back to the steam drum.

Such quench-cooling systems may be used for the rapid cooling of reaction gas or cracked gas from a cracking furnace or a chemical plant reactor by means of a boiling and partially evaporating medium, especially water, which is under a high pressure.

FIG. 2A shows an arrangement of a quench-cooling system, in which the primary quench cooler 10 and the secondary quench cooler 20, with features according to the invention, are arranged vertically under the steam drum 40. The reference numbers used in FIG. 1 for the same components shown remain unchanged, so that a further description of the schematic arrangement can, in principle, be omitted. The gas is fed in the vertically arranged secondary quench cooler 20 corresponding to the direction of the arrow, as in the primary quench cooler 10, from the lower end of the secondary quench cooler via the gas inlet 21 at the inlet header 22. The gas inlet 21 is connected to the gas outlet opening 12 of the primary quench cooler 10 via the pipeline 17. The gas leaves the vertically arranged quench cooler 20 at the upper end of the outlet header 24 at the gas outlet 23.

The cooling medium, especially water, from the steam drum 40 is fed to the secondary quench cooler 20 in FIG. 2A according to the direction of the arrow via the secondary feed pipeline 44 at the cooling water inlet 25 above the inlet header 22 and leaves the secondary quench cooler 20 back into the steam drum 40 via the secondary uptake tube 45 at the cooling water outlet 26 under the outlet header 24.

FIG. 2B shows a schematic arrangement of the quench-cooling system, which arrangement is similar to that in FIG. 2A. In the embodiment of a quench-cooling system being shown, the gas is fed according to the direction of the arrow via the pipeline 17 from the gas outlet opening 12 of the vertically arranged primary quench cooler 10 via the gas inlet 21 of the inlet header 22, which said gas inlet 21 is arranged at the upper end of the vertically arranged secondary quench cooler 20, with features according to the invention. The gas leaves the vertically arranged quench cooler 20 at the gas outlet 23 at the lower end of the gas outlet header 24.

In the arrangement shown in FIG. 2B, the cooling water is fed from the steam drum 40 according to the direction of the arrow from the lower end above the outlet header 24 of the vertically arranged secondary quench cooler 20 via the secondary feed pipeline 44 at the cooling water inlet 25 and leaves the quench cooler as a water/steam mixture under the inlet header 22 via the cooling water outlet 26 and the secondary uptake tube 45 back into the steam drum 40.

Figure 3:
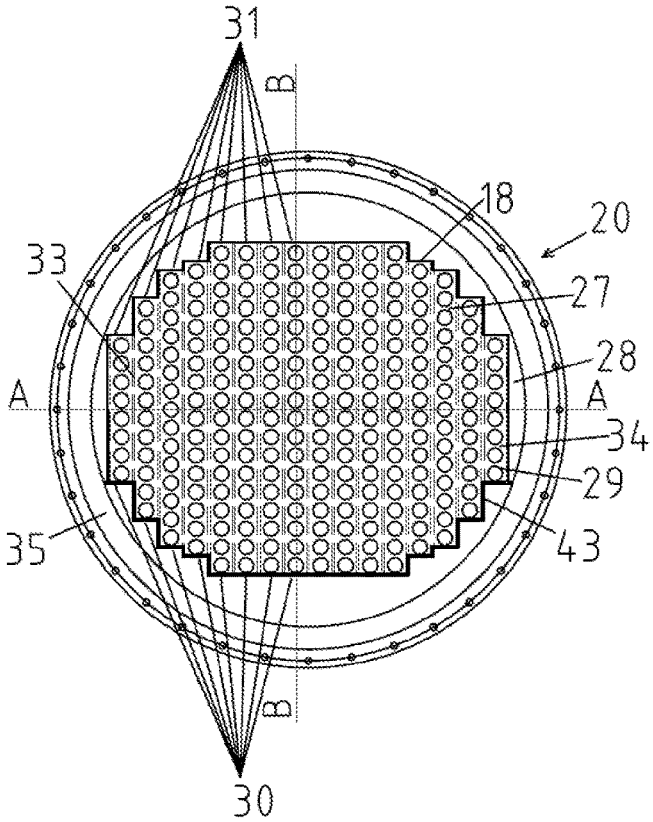
FIG. 3 is a sectional view showing a quench-cooling system according to the present invention with a design of cooling channels in a tunnel arrangement on a thin tube sheet of a secondary quench cooler, the section being cut a short distance above the tube sheet on a reduced scale in a top view.

FIG. 3 shows the design of cooling channels 27 in a tunnel arrangement on a thin tube sheet 28 of the secondary quench cooler 20 in a sectional view just above the tube sheet. The cooling channels 27 are arranged as tunnels in parallel on the thin tube sheet 28. The cooling channels 27 are provided with openings 18, which are arranged at a predetermined spaced location, on the surface formed by a covering sheet 34 at right angles to the tube sheet 28.

Figure 4A:
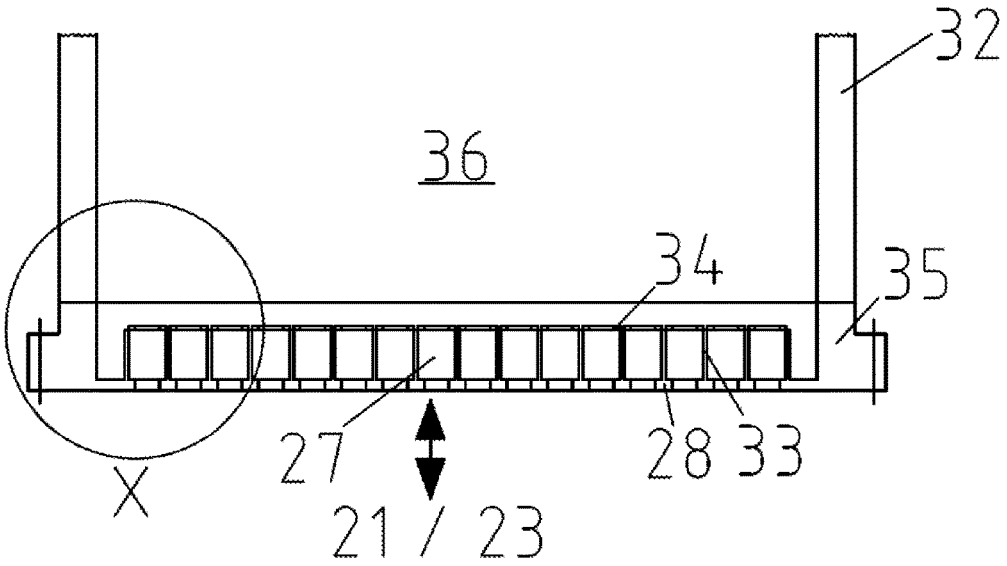
FIG. 4A is a sectional view showing a quench-cooling system according to the present invention with a design of cooling channels in a tunnel arrangement according to FIG. 3 with the section along line A-A.
Figure 4B:
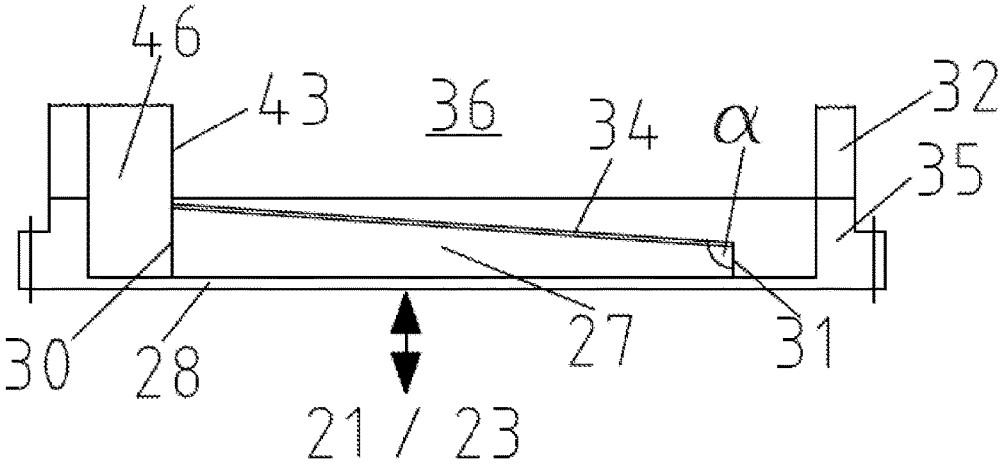
FIG. 4B is a sectional view showing a quench-cooling system according to the present invention with a design of a cooling channel in a tunnel arrangement according to FIG. 3 with the section along line B-B.
Figure 5:
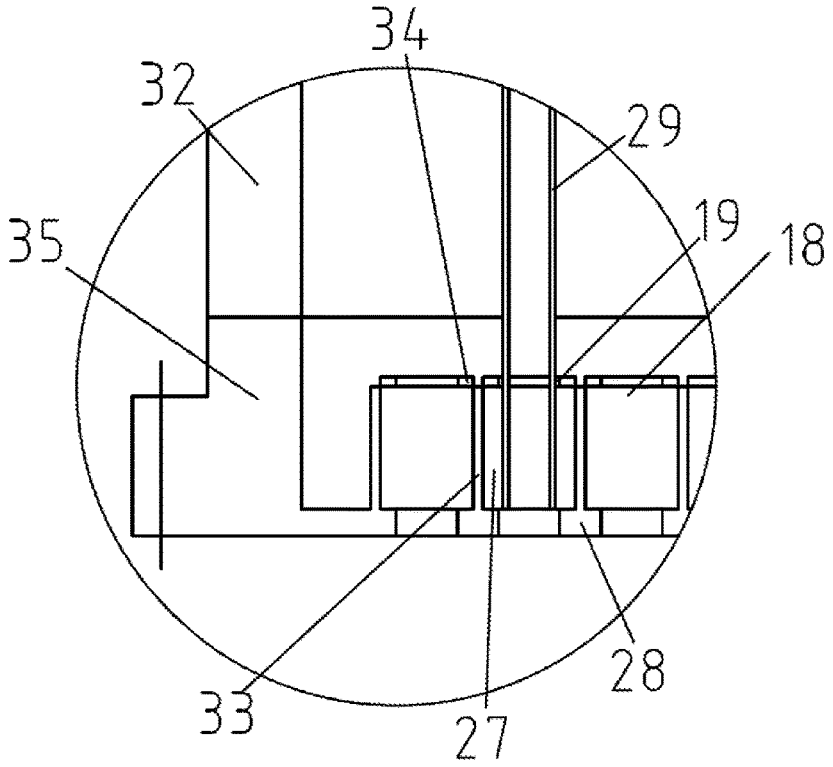
FIG. 5 is a detail view showing detail X according to FIG. 4A on a larger scale.

As can be seen more clearly in FIG. 3 in connection with FIGS. 4, 4B and FIG. 5, bundle tubes 29 of tube bundles are passed through the openings 18 at spaced locations from one another at right angles to the tube sheet 28 with a ring clearance 19, which is formed between the opening and the bundle tube and which is predetermined between the respective opening 18 and the bundle tube 29 passed through. One end each of the respective bundle tubes 29 is welded to the thin tube sheet 28, and the respective opposite ends of the bundle tubes are welded to a tube sheet, not shown, on the opposite side of the quench cooler 20, which is not shown.

The medium of the water/steam mass flow flows, according to FIG. 4B, over the secondary feed pipeline 44, not shown in FIG. 4B, to the cooling water inlet 25, not shown in FIG. 4B, of the secondary quench cooler 20. The mass flow is guided to inlet openings 30 of the cooling channels 27 configured in a tunnel arrangement by means of a baffle plate 43 adapted to the outer circumference of the arranged cooling channels 27. The entire mass flow is split among the individual tunnels or cooling channels 27 and passes, starting from the inlet openings 30, through all tunnels or cooling channels, while flowing around and thus cooling the bundle tubes 29 passed through at right angles to the cooling channels at spaced locations from one another, in the direction of outlet openings 31, which are arranged at spaced locations and aligned opposite the inlet openings 30. Consequently, an unambiguously directed flow develops from the inlet openings 30 to the outlet openings 31.

While flowing through the tunnels or cooling channels 27, a small portion of the mass flow passes according to FIG. 5 through the individual ring clearances 19, which are formed each between the openings 18 of the individual cooling channels and the bundle tubes 29 passed through at right angles thereto. The ring clearances 19 are preferably provided for an intensive cooling of the bundle tubes 29 to be able to occur in the area of the ring clearances, because a part of the mass flow passes through the ring clearances 19 and effective heat dissipation is achieved.

The mass flows merge again behind the outlet openings 31 according to FIG. 4B and enter a casing room 36, which encloses the tube bundle and is enclosed by the casing 32 of the secondary quench cooler. The casing 32 is welded to a ring flange 35, which is connected to the tube sheet 28.

FIG. 4A shows a section along line A-A according to FIG. 3, and FIG. 4B shows a section along line B-B according to FIG. 3.

The cooling channels 27 or tunnels, which are separated by webs 33 on the thin tube sheet 28, extend in parallel, are covered by the covering sheet 34 and are separated by webs 33 from one another, can be clearly seen in FIG. 4A, the bundle tubes 29 passed through the openings 18 being omitted for clarity's sake. The cooling channels 27 are arranged in parallel on the tube sheet 28, which is connected to the ring flange 35, which is welded to the casing 32 of the quench cooler 20. The cooling channels 27 in a tunnel arrangement are located in the water/steam area of the casing room 36 enclosed by the casing 32 with the enclosed tube bundle. The tube sheet 28 is arranged with the cooling channels 27 in a tunnel arrangement, which cooling channels are arranged thereon, on the side of the gas inlet 21 or of the gas outlet 23 according to the direction of the arrow, depending on the arrangement according to FIG. 2A or FIG. 2B of the quench-cooling system.

FIG. 4B shows a cooling channel 27 or tunnel with the covering sheet 34, whose inlet opening 30 is larger than the outlet opening 31. The cooling channel 27 is arranged on the thin tube sheet 28, which is connected to the ring flange 35. The ring flange 35 is welded to the casing 32 of the quench cooler 20, which encloses the casing room 36. The baffle plate 43, which is adapted to the outer circumference of the cooling channels and splits the water/steam mass flow among the individual cooling channels 27, is arranged within the casing room 36 on the tube sheet 28, forming a water chamber 46.

The cooling channel 27 in a tunnel arrangement, which is shown in FIG. 4B, shows a change in the cross section of the tunnel due to a continuous reduction of the tunnel height from the inlet opening 30 to the outlet opening 31. The continuous reduction of the tunnel height between the vertical line of the outlet opening and the covering sheet is determined by an angle. The predetermined angle depends on the required increase in the velocity of the flow over predetermined areas of the tube sheet and is in the range of greater than/equal to 90° to 110°.

FIG. 5 shows a detail X according to FIG. 4A, wherein the cooling channels 27 in a tunnel arrangement, which are formed from the webs 33 extending in parallel and the covering sheet 34 with the openings 18 for the bundle tubes 29 passed through, including the ring clearances 19, can be clearly seen in connection with the tube sheet 28. The cooling channels 27 in a tunnel arrangement, which are arranged on the thin tube sheet 28, are enclosed by the ring flange 35, which is connected to the tube sheet and the casing 32 of the quench cooler 20.

In vertically arranged secondary quench coolers 20, the tunnel arrangement is always arranged at the deepest sites of the quench cooler on the water/steam side. It is not important in this connection whether it is the gas inlet or the gas outlet. The tunnel arrangement is arranged in horizontally arranged secondary quench coolers 20 on the side of the gas inlet 21 on the water/steam side.

The entire tunnel arrangement of the cooling channels 27 or tunnels is enclosed by the ring flange 35. A preferred rectangular tunnel geometry is formed essentially by three components:

The thin tube sheet 28, which separates the gas side from the water/steam side, is connected to the ring flange 35.

The webs 33, which separate the individual water/steam flows from one another, so that an unambiguously directed flow can be obtained from the inlet openings 30 in the direction of the outlet openings 31 of the cooling channels 27 or tunnels, wherein the webs are connected to the tube sheet 28.

The covering sheet 34, which ensures a definition of the flow in the tunnel arrangement of the cooling channels 27 and prevents essentially the flow from escaping, aside from an intended percentage, which passes through the ring clearances 19, into a casing room 36, which is enclosed by the casing 32 and which encloses the bundle tubes 29 of the tube bundle. The covering sheet 34 is connected, especially welded, to the webs 33.

An unambiguously directed flow from the inlet openings 30 in the direction of the outlet openings 31 of the cooling channels 27 is ensured with the cooling channels 27 being configured in a tunnel arrangement.

Figure 6:
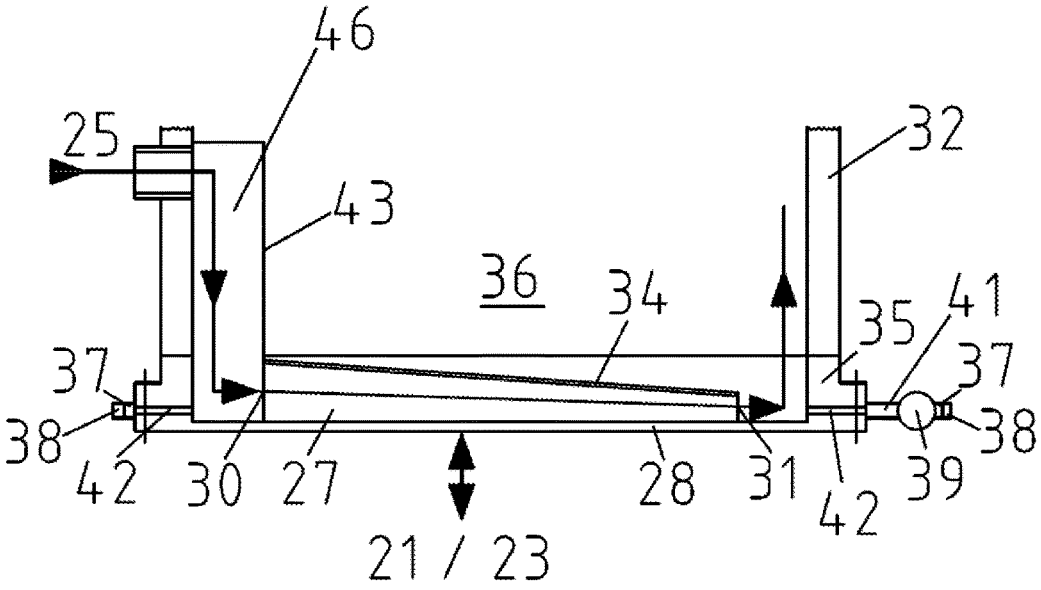
FIG. 6 is a schematic view showing a design of a cooling channel or tunnel for increasing the velocity of flow of the medium over a tube sheet of a secondary quench cooler for the quench-cooling system according to the present invention according to FIG. 4B with cooling water inlet.

FIG. 6 shows the view of a cooling channel 27 in a tunnel arrangement according to FIG. 4B with the course of the flow of the cooling medium. The ring flange 35, which is connected to the tube sheet 28, on which the cooling channels 27 are arranged in a tunnel arrangement, can be clearly seen in the view. The ring flange 35 is connected to the casing 32 of the quench cooler 20, not shown, and the casing room 36 is formed, which encloses the bundle tubes, not shown, of the tube bundle and encloses a water/steam area.

At the cooling water inlet 25, the cooling medium enters, according to the direction of the arrow, the inlet chamber 46, which extends over half of the circumference of the casing 32 and is defined essentially by the baffle plate 43, which is connected, preferably welded, to the tube sheet 28 along the inlet openings 30 of the cooling channels 27 and correspondingly to the casing 32 just above the cooling water inlet. From the inlet chamber 46, the cooling medium reaches the individual inlet openings 30 of the cooling channels 27 and leaves the cooling channels at the outlet openings 31 and enters the casing room 36. Furthermore, the arrows indicate that the tube sheet 28 may be arranged on the side of the gas inlet 21 or of the gas outlet 23, depending on the arrangement of the quench cooler.

The predetermined reduction of the cross section from the inlet opening 30 to the outlet opening 31 of the cooling channel 27 or tunnel is intended for increasing the velocity of flow of the water/steam mass flow. The increase in the velocity of flow of the mass flow, which is associated with the reduction of the cross section, is very essential for the more intense cooling of highly stressed parts of the tube sheet 28, above all of the middle of the tube sheet, for a longer service life of the quench cooler 20 and hence of the quench-cooling system.

The special design of the cooling channels 27 in a tunnel arrangement is necessary to rule out the formation of deposits on the inner side or water side of the tube sheet 28. To prevent deposits, the directed flow over the tube sheet has to have a defined velocity. Therefore, while maintaining the mass flow in the tunnels, the necessary velocity is to be adapted by changing the cross section of the tunnels. The change in the cross section of the tunnels is achieved by a continuous reduction of the tunnel height.

Figure 7:
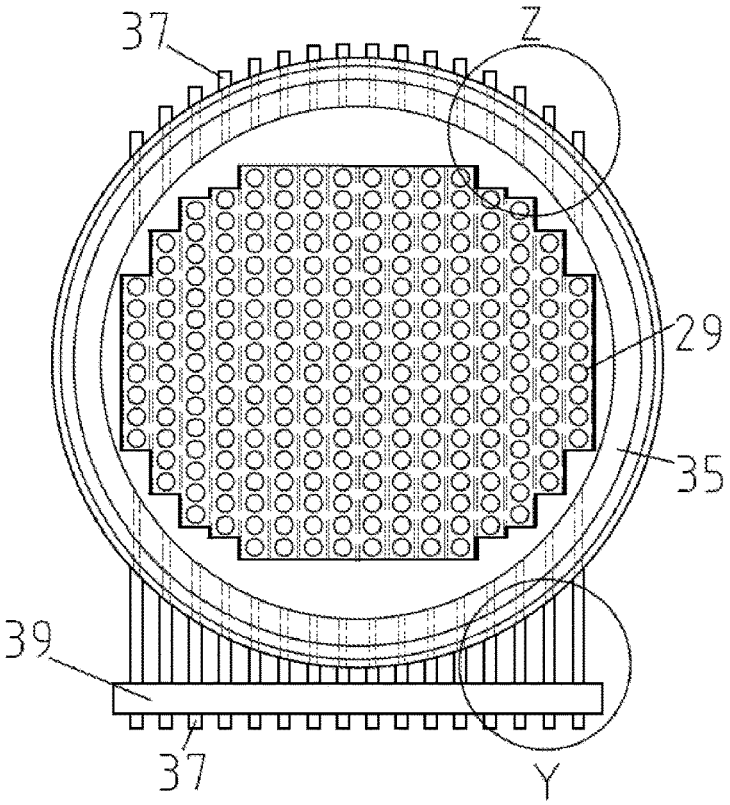
FIG. 7 a sectional view showing a design for an access to cooling channels arranged in a tunnel arrangement on a thin tube sheet of a secondary quench cooler of the quench-cooling system according to the present invention, the sectional view being according to FIG. 3.

FIG. 7 shows a view similar to that in FIG. 3, and inspection or cleaning nozzles 37, which are arranged on the ring flange 35 flush and opposite each other on the casing side, are associated with the respective inlet openings 30 and outlet openings 31. The inspection or cleaning nozzles 37 are provided with a cover 38 each, which are arranged separably in the area of the tunnel arrangement in case of a water-side maintenance or inspection of the bundle tubes 29. The covers or only individual covers 38 may be removed for such operations in the inspection or cleaning nozzles 37, which are located opposite each other.

The separably arranged covers 38 of the inspection or cleaning nozzles 37 are provided as a opening or access for inspecting or cleaning the tunnel arrangement of the cooling channels 27. The covers 38 of the respective inspection or cleaning nozzles 37 located opposite each other are removed for inspection or cleaning. Any deposits that may be present can be detected by means of a measuring device through the inspection or cleaning nozzles 37 with the covers 38 removed. The detected deposits can be removed from one opening up to the opposite opening by means of a high-pressure water jet. The deposits to be removed with a high-pressure water jet are preferably fed to a boiler blow-down tank 39, which is attached on one side of the inspection or cleaning nozzles 37 and receives and draws off the blow-down water.

Figure 8:
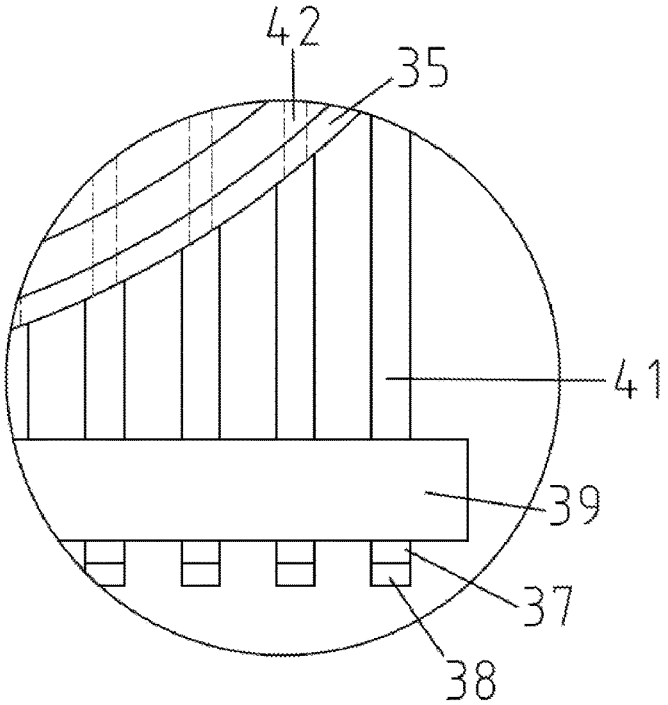
FIG. 8 is a detail view showing a detail Y according to FIG. 7 on a larger scale.

Detail Y is shown in FIG. 8 on a larger scale according to FIG. 7. It can be clearly seen from FIG. 8 that the boiler blow-down tank 39 for receiving the blow-down water is connected on one side to drain pipes 41. The drain pipes 41 are welded to the ring flange 35 at the level of the tunnel arrangement of the cooling channels 27, not shown, and are configured, via drill openings 42 in the ring flange 35, as accesses to the tunnel arrangement of the cooling channels. The inspection or cleaning nozzles 37 with the covers 38 are arranged on the other side of the boiler blow-down tank 39, which inspection or cleaning nozzles 37 with the covers 38 are located opposite the drain pipes 41.

Figure 9:
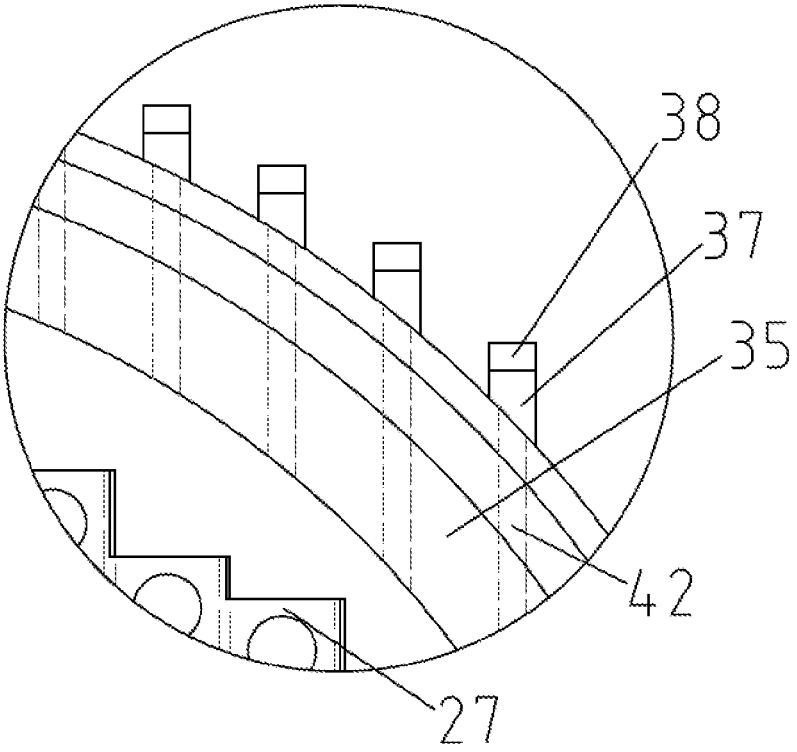
FIG. 9 is a detail view showing a detail Z according to FIG. 7 on a larger scale.

FIG. 9 shows a detail Z on a larger scale according to FIG. 7. The inspection or cleaning nozzles 37 are arranged directly on the ring flange 35, and they are specifically arranged in parallel and directed in one line in the direction of the inspection or cleaning nozzles arranged on the side opposite the side on which the boiler blow-down tank 39 according to FIG. 8 is arranged. Via drill openings 42 in the ring flange 35, the inspection or cleaning nozzles 37 provide access to the tunnel arrangement of the cooling channels 27 for an inspection or cleaning of the cooling channels or tunnels While specific embodiments of the invention have been shown and described in detail to illustrate the application of the principles of the invention, it will be understood that the invention may be embodied otherwise without departing from such principles.

APPENDIX

List of Reference Numbers

10 primary quench cooler
11 gas inlet opening
12 gas outlet opening
13 cooling water inlet opening
14 cooling water outlet opening
15 feed pipeline from steam drum to primary quench cooler
16 uptake tube from primary quenchcooler to steam drum
17 pipeline between primary and secondary quench cooler
18 opening
19 ring clearance
20 secondary quench cooler
21 gas inlet
22 inlet header
23 gas outlet
24 outlet header
25 cooling water inlet
26 cooling water outlet
27 cooling chanal
28 tube sheet
29 bundle tube
30 inlet opening
31 outlet opening
32 casing of tube bundle
33 web
34 covering sheet
35 ring flange
36 casing room
37 inspection or cleaning nozzle covers
39 boiler blow-down tank
40 steam drum
41 drain pipe
42 drill holes
43 baffle plate
44 feed pipeline for water/steam of secundary quench cooler
45 uptake tube for water/steam of secundary quench cooler
46 inlet chamber for cooling medium

What is claimed is:

1. A quench-cooling system comprising:

a primary quench cooler as a double-tube heat exchanger; and a tube bundle heat exchanger as a secondary quench cooler, the tube bundle heat exchanger comprising:

at least one tube bundle comprising bundle tubes;

a casing enclosing the at least one tube bundle;

a ring flange connected to the casing;

two tube sheets arranged at spaced locations from one another and forming a casing room with the casing, between the two tube sheets, with bundle tubes of the tube bundle being held between said two tube sheets at sides, wherein at least one of the two tube sheets is configured on the side of a bundle tube gas inlet or a bundle tube gas outlet as a membrane sheet or thin tube sheet;

parallel webs arranged on and connected to the membrane sheet or thin tube sheet; and a covering sheet connected to the webs and provided with bundle tube openings for bundle tubes, wherein parallel cooling channels, in flow connection with one another and through which a cooling medium flows, are configured in a tunnel arrangement on the membrane sheet or thin tube sheet, the parallel cooling channels in the tunnel arrangement having a rectangular tunnel geometry in cross section defined by:

the membrane sheet or thin tube sheet, which separates a gas side from a water/steam side and is connected to the ring flange;

the parallel webs, which separate individual water/steam flows from one another; and the covering sheet, the covering sheet defining a flow in the tunnel arrangement of the cooling channels and closing off flow into the casing room aside from a predetermined percentage, whereby the cooling channels bring about a directed flow from inlet openings to outlet openings of the cooling channels, wherein at least two cooling channels in the tunnel arrangement have a cross section change based on a continuous reduction of a tunnel height from the inlet opening to the outlet opening based on a predetermined angle between a vertical line of the outlet opening and of the covering sheet.

2. A quench-cooling system in accordance with claim 1, wherein the predetermined angle corresponds to a predetermined increase in a velocity of flow of the cooling medium over predetermined areas of the membrane sheet or thin tube sheet to be cooled and is in the range of 90° to 110°.

3. A quench-cooling system in accordance with claim 1, wherein:

the cooling channels in the covering sheet have the bundle tube openings in the horizontal direction at spaced locations from one another;

the bundle tube openings are configured such that ring clearances are formed for the respective bundle tubes passing through the bundle tube openings; and the respective ring clearance brings about a passage of the cooling medium for cooling between the respective bundle tube and the respective opening of the bundle tube openings.

4. A quench-cooling system in accordance with claim 1, further comprising inspection or cleaning nozzles, which are arranged on the outer surface side of the ring flange connected to the casing opposite each other and aligned with the cooling channels, wherein:

the ring flange has drill openings;

the cooling channels in the tunnel arrangement communicate via the drill openings in the ring flange with the inspection or cleaning nozzles.

5. A quench-cooling system in accordance with claim 4, further comprising covers, wherein the inspection or cleaning nozzles, which are associated with the cooling channels and are arranged opposite and aligned with the cooling channels on the ring flange, are equipped with the covers and at least one of all of the covers of the respective inspection or cleaning nozzles located opposite each other is arranged removably as an opening for the water/steam side maintenance or inspection of the bundle tubes in the area of the cooling channels in the tunnel arrangement.

6. A quench-cooling system in accordance with claim 5, wherein the covers of the inspection or cleaning nozzles are arranged opposite each other on the ring flange and are arranged removably as an opening for removing deposits present in the area of the cooling channels in the tunnel arrangement.

7. A quench-cooling system in accordance with claim 4, wherein the inspection or cleaning nozzles, which are associated with the cooling channels and are arranged opposite each other on the ring flange, communicate with a boiler blow-down tank arranged on one side at the level of the cooling channels in the tunnel arrangement via the drill openings in the ring flange and via welded-on drain pipes as an extension of the drill openings on the ring flange.

8. A quench-cooling system in accordance with claim 7, wherein the inspection or cleaning nozzles associated with the cooling channels are arranged on the outer side of the boiler blow-down tank, which side is located opposite the drain pipes.

9. A quench-cooling system in accordance with claim 7, wherein the inspection or cleaning nozzles are arranged directly on the ring flange opposite the side on which the boiler blow-down tank is arranged as a continuation of the drill openings in the ring flange.

10. A quench-cooling system in accordance with claim 7, wherein:

with the covers removed, a continuous access is obtained to each cooling channel arranged on the membrane sheet or thin tube sheet via the inspection or cleaning nozzles;

each cooling channel is arranged such that the cooling channel is cleaned either from both sides or from only one side by introducing water as a medium under pressure into the inspection or cleaning nozzles; and each channel is connected to the provided boiler blow-down tank for draining the blow-down water via the associated drain pipe.

* * * * *